US007749597B2

(12) United States Patent
Tsushima et al.

(10) Patent No.: US 7,749,597 B2
(45) **Date of Patent: *Jul. 6, 2010**

(54) CARBON FIBER TI-AL COMPOSITE MATERIAL AND PROCESS FOR PRODUCING THE SAME

(75) Inventors: Eiki Tsushima, Fuji (JP); Kazuyuki Murakami, Fuji (JP); Susumu Katagiri, Chiyoda-ku (JP); Nobuyuki Suzuki, Fuji (JP)

(73) Assignees: Mitsubishi Corporation, Tokyo (JP); FJ Composite Materials Co., Ltd., Fuji-shi (JP); Advanced Material Technologies Co., Ltd., Fuji-shi (JP)

( * ) Notice: Subject to any disclaimer, the term of this patent is extended or adjusted under 35 U.S.C. 154(b) by 411 days.

This patent is subject to a terminal disclaimer.

(21) Appl. No.: 11/574,767

(22) PCT Filed: Jun. 2, 2005

(86) PCT No.: PCT/JP2005/010196

§ 371 (c)(1),
(2), (4) Date: Mar. 6, 2007

(87) PCT Pub. No.: WO2006/027879

PCT Pub. Date: Mar. 16, 2006

(65) Prior Publication Data

US 2008/0003426 A1 Jan. 3, 2008

(30) Foreign Application Priority Data

Sep. 6, 2004 (JP) ..... 2004-258749

(51) Int. Cl.
*B32B 15/04* (2006.01)

(52) U.S. Cl. ..... 428/293.1; 428/408; 164/97; 164/98; 188/251 R

(58) Field of Classification Search ..... 428/293.1, 428/408, 299.1; 188/251 R, 251 A, 251 M; 164/97, 98

See application file for complete search history.

(56) References Cited

U.S. PATENT DOCUMENTS 3,853,635 A * 12/1974 Demendi ..... 148/549

(Continued)

FOREIGN PATENT DOCUMENTS

JP 2003-49252 2/2003

(Continued)

OTHER PUBLICATIONS

U.S. Appl. No. 11/630,887, filed Dec. 27, 2006, Tsushima, et al.

(Continued)

*Primary Examiner*—N. Edwards
(74) *Attorney, Agent, or Firm*—Oblon, Spivak, McClelland, Maier & Neustadt, L.L.P.

(57) ABSTRACT

To provide a carbon fiber Ti—Al composite material having hardness, heat resistance and abrasion resistance, having reduced weight, improved strength, elastic modulus and thermal conductivity and being excellent in the uniformity of the quality.

A carbon fiber Ti—Al composite material which is prepared by pressure impregnating a molded product containing fine carbon fibers having a fiber diameter of from 0.5 to 500 nm and a carbon length of at most 1,000 μm and having a hollow-structured central axis, carbon long fibers having a fiber diameter of from 5 to 15 μm and a titanium powder or a titanium oxide powder, with aluminum or an aluminum alloy by molten metal forging.

10 Claims, 1 Drawing Sheet

U.S. PATENT DOCUMENTS

| | | | | |
|---|---|---|---|---|
| 6,649,265 | B1 * | 11/2003 | Kawamura et al. | 428/408 |
| 6,860,314 | B1 * | 3/2005 | Koide et al. | 164/113 |
| 6,998,434 | B2 * | 2/2006 | Wadahara et al. | 524/495 |
| 7,410,603 | B2 * | 8/2008 | Noguchi et al. | 264/122 |
| 2002/0192143 | A1 * | 12/2002 | Miyazawa et al. | 423/447.2 |
| 2006/0142149 | A1 * | 6/2006 | Ma et al. | 502/185 |
| 2007/0053166 | A1 * | 3/2007 | Hwang et al. | 361/717 |
| 2007/0202255 | A1 * | 8/2007 | Shinoda et al. | 427/255.6 |
| 2008/0003426 | A1 * | 1/2008 | Tsushima et al. | 428/332 |
| 2008/0026219 | A1 * | 1/2008 | Tsushima et al. | 428/367 |
| 2008/0050589 | A1 * | 2/2008 | Tsushima et al. | 428/376 |
| 2008/0090066 | A1 * | 4/2008 | Palumbo et al. | 428/297.7 |
| 2008/0254310 | A1 * | 10/2008 | Palumbo et al. | 428/551 |
| 2009/0220826 | A1 * | 9/2009 | Wang | 429/12 |

FOREIGN PATENT DOCUMENTS

| | | |
|---|---|---|
| JP | 2004-136363 | 5/2004 |

OTHER PUBLICATIONS

U.S. Appl. No. 11/630,681, filed Dec. 27, 2006, Tsushima, et al.
U.S. Appl. No. 11/631,106, filed Dec. 28, 2006, Tsushima, et al.

* cited by examiner

CARBON FIBER TI-AL COMPOSITE MATERIAL AND PROCESS FOR PRODUCING THE SAME

TECHNICAL FIELD

The present invention relates to a carbon fiber Ti—Al composite material excellent in heat resistance, high thermal conductivity, abrasion resistance, strength and elastic modulus, and its production process.

BACKGROUND ART

As a material which is excellent in heat resistance and abrasion resistance, which is light in weight and which is suitable as a slide material for a brake, a metal composite material prepared by impregnating a preliminary molded product of ceramic fibers or carbon fibers, or ceramic particles or carbon particles with a metal titanium powder, with aluminum or an aluminum alloy by molten metal forging, has been known (for example, Patent Document 1). Such a metal composite material has hardness and a moderate coefficient of friction in addition to the above characteristics, and thus it has characteristics required for a slide material for a brake so far.

On the other hand, in recent years, higher levels of performance and quality are required for a slide material for a brake in view of the safety and speeding up of automobiles, vehicles, etc., and stricter characteristics are required also for the above metal composite material. Further a material which is lighter in weight and has higher strength, and which has a high thermal conductivity, has been expected.

However, with respect to a conventional metal composite material, reduction in weight and further improvement in strength, the thermal conductivity, etc., are considered to be difficult from limitations of the ceramic fibers, the carbon fibers or the like for reinforcing. Further, since metal titanium is mixed with ceramic fibers, carbon fibers or the like for reinforcing (hereinafter referred to as reinforcing fibers or the like) to form a molded product, which is pressure impregnated with aluminum or an aluminum alloy by molten metal forging, miscibility of the reinforcing fibers or the like with metal titanium and wettability with an aluminum alloy or the like as the matrix are not sufficiently satisfactory. As a result, the above metal composite material has a problem such as low uniformity of the quality, in addition to the low miscibility with metal titanium at the time of production and low impregnation properties with the aluminum alloy or the like in the molten metal forging.

Patent Document 1. JP-A-2003-49252

DISCLOSURE OF THE INVENTION

Object to be Accomplished by the Invention

Under these circumstances, it is an object of the present invention to provide a carbon fiber Ti—Al composite material having hardness, heat resistance and abrasion resistance, having reduced weight and improved strength, elastic modulus and thermal conductivity and being excellent in uniformity of the quality, which is suitable for a slide material for a brake, an engine component, a robot arm, etc.

Means to Accomplish the Object

The present inventors have conducted extensive studies to accomplish the above object and as a result found that the above object can be accomplished by using, for a conventional metal composite prepared by pressure impregnating a molded product comprising reinforcing fibers or the like and a titanium powder mixed therewith, with an aluminum alloy or the like by molten metal forging, fine carbon fibers and carbon long fibers having specific physical properties as the reinforcing fibers, and further found that higher effects can be achieved by covering the surface of the fine carbon fibers and/or the carbon long fibers with a thermosetting resin such as a phenolic resin. The present invention has been accomplished on the basis of these discoveries.

Namely the present invention provides the following.

(1) A carbon fiber Ti—Al composite material which is prepared by pressure impregnating a molded product containing fine carbon fibers having a fiber diameter of from 0.5 to 500 nm and a carbon length of at most 1,000 μm and having a hollow-structured central axis, carbon long fibers having a fiber diameter of from 5 to 15 μm and a titanium powder or a titanium oxide powder, with aluminum or an aluminum alloy by molten metal forging.

(2) The carbon fiber Ti—Al composite material according to the above (1), wherein the fine carbon fibers are fine carbon fibers graphitized by heat treatment at a temperature of at least 2,300° C. in a non-oxidizing atmosphere.

(3) The carbon fiber Ti—Al composite material according to the above (1) or (2), wherein the volume fraction of the fine carbon fibers is from 20 to 70%.

(4) The carbon fiber Ti—Al composite material according to the above (1), (2) or (3), wherein the volume fraction of the carbon long fibers is from 0.5 to 50%.

(5) The carbon fiber Ti—Al composite material according to any one of the above (1) to (4), wherein the content of the titanium powder or the titanium oxide powder is from 15 to 50 vol %.

(6) The carbon fiber Ti—Al composite material according to any one of the above (1) to (5), wherein the fine carbon fibers and/or the carbon long fibers are fine carbon fibers covered with a thermosetting resin, the surface of which is covered with a thermosetting resin in an amount of from 1 to 40 parts by weight per 100 parts by weight of the fibers.

(7) A process for producing a carbon fiber Ti—Al composite material, which comprises mixing fine carbon fibers having a fiber diameter of from 0.5 to 500 nm and a carbon length of at most 1,000 μm and having a hollow-structured central axis, carbon long fibers having a fiber diameter of from 5 to 15 μm and a titanium powder or a titanium oxide powder to form a molded product, pre-heating the molded product in an inert atmosphere, disposing it in a pressure mold, and pressure impregnating the molded product with a molten metal of aluminum or an aluminum alloy by molten metal forging under a pressure of at least 20 MPa.

(8) The process for producing a carbon fiber Ti—Al composite material according to the above (7), wherein a binder is added to the mixture of the fine carbon fibers, the carbon long fibers and the titanium powder or the titanium oxide powder to form a molded product.

(9) The process for producing a carbon fiber Ti—Al composite material according to the above (7) or (8), wherein the fine carbon fibers and/or the carbon long fibers are fibers, the surface of which is covered with a thermosetting resin.

(10) The process for producing a carbon fiber Ti—Al composite material according to the above (9), wherein the fine carbon fibers and/or the carbon long fibers are fibers, the surface of thermosetting resin in an amount of at most 40 parts by weight per 100 parts by weight of the fibers.

EFFECTS OF THE INVENTION

The carbon fiber Ti—Al composite material of the present invention is prepared by mixing titanium or titanium oxide with fine carbon fibers and carbon long fibers having specific physical properties to form a molded product, and pressure impregnating the molded product with aluminum or an aluminum alloy by molten metal forging. Thus, a composite material having desired hardness, heat resistance and abrasion resistance, and having reduced weight and improved strength, elastic modulus and thermal conductivity can be obtained.

Further, by use of fine carbon fibers having the surface of the above fine carbon fibers covered with a thermosetting resin, miscibility with titanium or titanium oxide and wettability with aluminum or an aluminum alloy can be improved. Thus, uniform mixing with titanium or titanium oxide and smooth impregnation with aluminum or an aluminum alloy can be accelerated, whereby the operation efficiency will improve, and a composite material excellent in strength and uniformity of the quality can be obtained.

Further, by the carbon fiber Ti—Al composite material having the above structure, particularly by synergistic combination of the fine carbon fibers with the carbon long fibers, a reinforcing effect will be obtained, whereby a composite material having a dense and uniform structure will be obtained. Thus, in production or processing or during use of products employing such a material, cracks or breakage of the material will hardly occur. Accordingly, not only reliability of products improves but also processing will be easy, and products with high accuracy of finishing will be obtained.

MEANINGS OF SYMBOLS

Figure 1:
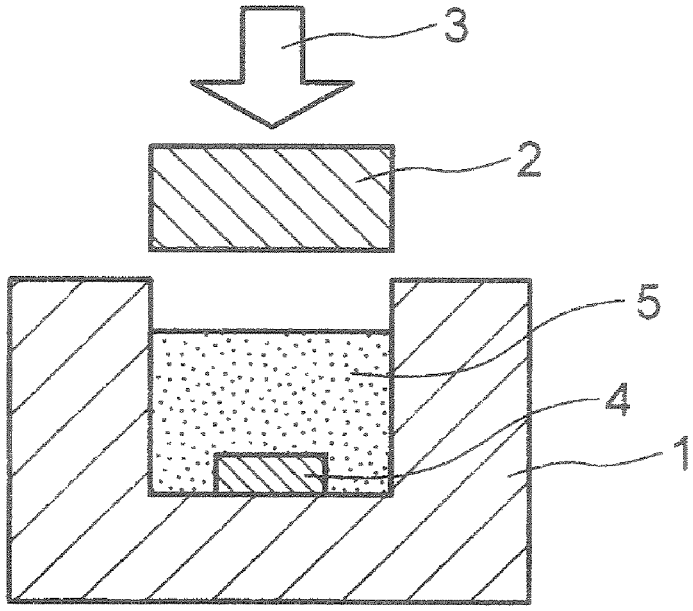
FIG. 1 is a cross section schematically illustrating one example of a molten metal forging apparatus of the present invention.

1: Mold
2: Punch
3: Pressing machine
4: Molded product
5: Molten metal

BEST MODE FOR CARRYING OUT THE INVENTION

The fine carbon fibers used in the present invention are fine carbon fibers having a fiber diameter of from 0.5 to 500 nm and a fiber length of at most 1,000 μm and preferably having an aspect ratio of from 3 to 1,000, preferably having a multilayer structure having cylinders comprising a carbon hexagonal plane concentrically disposed and having a hollow-structured central axis. The fine carbon fibers are greatly different from conventional carbon fibers not only in the fiber diameter and the fiber length but also in the structure. As a result, excellent physical properties such as electrical conductivity, thermal conductivity and sliding properties are achieved.

If the fiber diameter of the fine carbon fibers is smaller than 0.5 nm, the strength of the composite material to be obtained will be insufficient, and if it is larger than 500 nm, mechanical strength, thermal conductivity, sliding properties, etc. will be low. Further, if the fiber length is longer than 1,000 μm, the fine carbon fibers are hardly dispersed uniformly in the matrix such as aluminum or an aluminum alloy (hereinafter they will generically be referred to as an aluminum metal) whereby the composition of the material tends to be non-uniform, and the composite material to be obtained tends to have low mechanical strength. The fine carbon fibers used in the present invention are particularly preferably ones having a fiber diameter of from 10 to 200 nm and a fiber length of from 3 to 300 μm, and preferably an aspect ratio of from 3 to 500. In the present invention, the fiber diameter and the fiber length of the fine carbon fibers can be measured by an electron microscope.

Preferred fine carbon fibers used in the present invention are carbon nanotubes. The carbon nanotubes are also called graphite whisker, filamentous carbon, carbon fibrils or the like, and they are classified into single layer carbon nanotubes comprising a single graphite layer forming the tube and multilayer carbon nanotubes comprising a plurality of layers, and both can be used in the present invention. However, multilayer carbon nanotubes are preferred, with which high mechanical strength will be obtained and which are advantageous in economical viewpoint.

Carbon nanotubes are produced by e.g. arc discharge, laser vaporization or heat decomposition, for example, as disclosed in "Fundamentals of Carbon Nanotubes" (published by CORONA PUBLISHING CO., LTD., pages 23 to 57, 1998). The carbon nanotubes are preferably ones having a fiber diameter of from 0.5 to 500 nm, a fiber length of from 1 to 500 μm and an aspect ratio of from 3 to 500.

Particularly preferred fine carbon fibers in the present invention are vapor grown carbon fibers having relatively large fiber diameter and fiber length among the above carbon nanotubes. Such vapor grown carbon fibers are also called VGCF, and produced by vapor phase heat decomposition of a gas of e.g. a hydrocarbon together with a hydrogen gas in the presence of an organic transition metal type catalyst, as disclosed in JP-A-2003-176327. The vapor grown carbon fibers (VGCF) have a fiber diameter of preferably from 50 to 300 nm, a fiber length of preferably from 3 to 300 μm, and preferably have an aspect ratio of from 3 to 500. The VGCF are excellent in view of productivity and handling efficiency.

The fine carbon fibers used in the present invention are preferably subjected to heat treatment at a temperature of at least 2,300° C., preferably from 2,500 to 3,500° C. in a non-oxidizing atmosphere, whereby the surface will be graphitized, and the mechanical strength and the chemical stability will greatly improve, and the composite material to be obtained will be light in weight. As the non-oxidizing atmosphere, an argon, helium or nitrogen gas is preferably used. In a case where in this heat treatment, a boron compound such as boron carbide, boron oxide, boric acid, a borate, boron nitride or an organic boron compound coexists, the above effects by the heat treatment will further improve and further, the heat treatment temperature will be reduced, and the heat treatment will be advantageously carried out. Such a boron compound is present preferably with a boron content of from 0.01 to 10 mass %, preferably from 0.1 to 5 mass % in the heat treated fine carbon fibers.

In the composite material of the present invention, the carbon long fibers to be used with the fine carbon fibers may be any of PAN type, pitch type and other carbon fibers, and preferred are ones having a diameter of from 5 to 15 μm, preferably from 7 to 12 μm. Further, with respect to the length, the carbon long fibers may be in the form of long continuous fibers, but the fiber length is preferably from 0.1 to 10 mm, particularly preferably from 1 to 5 mm, whereby a material having favorable dispersiblity and having characteristics without anisotropy, will be obtained. Among them, pitch type carbon fibers having a high thermal conductivity, particularly high quality meso phase pitch type carbon fibers are preferred.

The composite material of the present invention which contains the carbon long fibers, has the advantage of having improved mechanical characteristics, particularly strength and elastic modulus of the composite material, and further has an economical advantage, since the amount of expensive fine carbon fibers can be reduced.

The composite material of the present invention may further contain, as a carbon material, a carbonaceous powder as the case requires in addition to the above fine carbon fibers and the carbon long fibers. The composite material, which contains a carbonaceous powder, has the advantage of having improved thermal conductivity, and further has an economical advantage, since the amount of expensive fine carbon fibers can be reduced.

In the present invention, a powder of titanium and titanium oxide (hereinafter sometimes they will generically be referred to as a titanium powder) is mixed with the above fine carbon fibers and the carbon long fibers to form a molded product, and the molded product is brought into contact with molten aluminum metal under elevated pressure, so that the molded product is pressure impregnated with molten aluminum metal (hereinafter sometimes referred to as molten metal) by molten metal forging to produce a carbon fiber Ti—Al composite material.

The above titanium powder is usually preferably a powder of metal titanium in view of the reactivity of titanium with aluminum. Further, as the particle size of the titanium powder, the average particle size is preferably from 1 to 150 μm. A titanium powder having a particle size within this range will easily be mixed with the fine carbon fibers and the carbon long fibers and will react with aluminum metal to accelerate formation of an intermetallic compound of Al—Ti. Further, a metal forming an aluminum alloy may, for example, be Mg, Si or Cu, and among them, Si is used in many cases. The powder of titanium or titanium oxide may be used alone or in combination, and further, aluminum or an aluminum alloy may be used in combination as aluminum metal.

The molded product containing the fine carbon fibers and the carbon long fibers is obtained by mixing a predetermined amount of a titanium powder with the fine carbon fibers and the carbon long fibers, preferably suitably mixing a binder such as a PVA (polyvinyl alcohol), an epoxy resin a furan resin or a phenolic resin therewith, and pressure molding the mixture by a mold into a predetermined shape. The molded product is dried as the case requires.

The shape of the molded product varies depending upon the purpose of use and is not limited, and a suitable shape such as a plate, a disk, a prism, a cylinder, a column, a rectangular solid or a sphere may be employed. Usually, a plate which is easily molded and which is widely applicable, is employed. For example, as a slide material for a brake, a disk having a thickness of preferably from 2 to 100 mm more preferably from 3 to 50 mm is preferred. The molded product suitably has a density of from about 2.4 to about 3.5 g/cm$^3$.

In production of the molded product, the fine carbon fibers and/or the carbon long fibers may be used as they are, but use of ones, the surface of which is covered with a thermosetting resin such as a phenolic resin is preferred. The fine carbon fibers and/or the carbon long fibers the surface of which is covered with a thermosetting resin, may be produced by using a preliminarily prepared thermosetting resin powder in such a manner that the resin powder as it is, or a resin powder diluted with a solvent such as an alcohol or acetone, is mixed with the fine carbon fibers and/or the carbon long fibers and kneaded by means of e.g. a kneader the kneaded product is extruded and dried and then pulverized. However, the fibers the surface of which is covered with a thermosetting resin thus obtained, has an amount of the covering thermosetting resin of so large as from about 30 to about 50 mass % on the basis of the carbon fibers. If the amount of the thermosetting resin is large, the amount of the carbon fibers is relatively small, and accordingly mechanical strength, electrical conductivity, thermal conductivity, etc. tend to decrease.

Thus, not a preliminarily produced thermosetting resin is used, but, for example, in a case where the thermosetting resin is a phenolic resin, a phenol and an aldehyde as materials thereof are reacted while they are mixed with the fine carbon fibers and/or the carbon long fibers in the presence of a catalyst, whereby the surface of the carbon fibers can be uniformly covered with a phenolic resin very thinly. As a result, fine carbon fibers and/or carbon long fibers having an amount of the covering thermosetting resin of at most 40 mass %, or at most 25 mass %, can easily be obtained by such a covering method.

The phenol to be used for formation of a phenolic resin in the above covering method may, for example, be a usual phenol such as phenol, catechol, tannin, resorcin, hydroquinone or pyrogallol. Among them, hydrophobic one which is hardly soluble in water is preferably used. Such a hydrophobic phenol is preferably one having a solubility in water of at most 5 at room temperature (30° C.). The solubility in water is defined by the number of grams soluble in 100 g of water, and the solubility in water of at most 5 means that dissolution of at most 5 g in 100 g of water brings about a saturated state. The solubility is preferably low.

The above hydrophobic phenol may, for example, be o-cresol, m-cresol, p-cresol, p-t-butylphenol, 4-t-butylcatechol, m-phenylphenol, p-phenylphenol, p-(α-cumyl)phenol, p-nonylphenol, guaiacol, bisphenol A, bisphenol S, bisphenol F, o-chlorophenol, p-chlorophenol, 2,4-dichlorophenol, o-phenylphenol, 3,5-xylenol, 2,3-xylenol, 2,5-xylenol, 2,6-xylenol, 3,4-xylenol or p-octylphenol. They may be used alone or as a mixture of two or more in combination. In the present invention, among phenols used, at least 5 mass % is preferably a hydrophobic phenol. Only a hydrophobic phenol may be used as the phenol.

Further, the aldehyde used as the material of the phenolic resin is most suitably formalin which is in a state of an aqueous solution of formaldehyde, but trioxane, tetraoxane, paraformaldehyde or the like may also be used, and further, part or most part of formaldehyde may be replaced with furfural or furfuryl alcohol.

Further, the catalyst for addition condensation of the phenol with the aldehyde is preferably an oxide, a hydroxide or a carbonate of an alkali metal such as sodium, potassium or lithium, an oxide, a hydroxide or a carbonate of an alkaline earth metal such as calcium, magnesium or barium, or a tertiary amine. They may be used alone or as a mixture of two or more in combination. Specific examples include sodium hydroxide, potassium hydroxide, lithium hydroxide, sodium carbonate, calcium hydroxide, magnesium hydroxide, barium hydroxide, calcium carbonate, magnesium oxide, calcium oxide, trimethylamine, triethylamine, triethanolamine and 1,8-diazabicyclo[5,4,0]undecene-7.

In production of the fine carbon fibers and/or the carbon long fibers covered with a phenolic resin, a phenol, an aldehyde and a reaction catalyst are put in a reaction container, and fine carbon fibers and/or other component used if necessary are further put to the reaction container, whereby the phenol and the aldehyde are reacted in the presence of these components. This reaction is carried out preferably with stirring in water in an amount sufficient for stirring the reaction system, and the reaction system is viscous at the beginning of the reaction and becomes fluid along with stirring. As the reaction proceeds, the condensate of the phenol with the aldehyde containing fine carbon fibers starts being separated from water in the system, and composite particles comprising the formed phenolic resin and the carbon fibers agglomerated are dispersed in the entire reaction container.

The reaction of the phenolic resin is further allowed to proceed to a desired extent, the reaction system is cooled and then stirring is terminated, whereupon the fine carbon fibers and/or the carbon long fibers covered with the phenolic resin are precipitated and separated from water, and they can easily be separated from water by filtration, which are dried to is easily obtain fine carbon fibers covered with a phenolic resin.

In the fine carbon fibers and/or the carbon long fibers covered with a thermosetting resin such as a phenolic resin produced as mentioned above, the surface of the carbon fibers is uniformly covered with a phenolic resin very thinly. Thus, the amount of the covering thermosetting resin is brought to be from 1 to 40 parts by weight per 100 parts by weight of the fine carbon fibers and/or the carbon long fibers. If the amount is larger than 40 parts by weight, the amount of the fibers tends to be small, whereby the strength tends to decrease, and on the other hand, if the amount is smaller than 1 part by weight, no uniform molded product will be produced.

Further, in production of the molded product containing the above fine carbon fibers, it is preferred to preliminarily mix the fine carbon fibers and/or the carbon long fibers with a powder of aluminum metal with which the molded product is to be impregnated in the subsequent step and to mold a mixture, whereby metal impregnation properties in the molten metal forging will remarkably be improved. In this case, the amount of the powder of aluminum metal mixed is preferably from about 10 to about 50 parts by weight per 100 parts by weight of the total amount of the fine carbon fibers and/or the carbon long fibers. Further, the average particle size of the powder of aluminum metal is suitably from 1 to 150 μm.

Then, the molded product is disposed in a pressure mold and brought into contact with molten aluminum metal under elevated pressure so that the molded product is pressure impregnated with aluminum metal by teeming by molten metal forging. In such a case, in step (1) first, the molded product is disposed in a mold and then pre-heated together with the mold preferably in an inert atmosphere. As the inert atmosphere, an argon gas, a nitrogen gas or the like may be used, and an argon gas is preferably used. Further, pre-heating is carried out by holding the molded product at a temperature of the melting point of aluminum metal or higher, specifically at a temperature higher by at least 100° C., more preferably from 100 to 250° C. than the melting point. By means of this step (1), aluminum metal can be uniformly infiltrated into pores in the porous molded product while fluidity of aluminum metal is maintained and the reaction at the interface between the fine carbon fibers or the carbon long fibers and the metal is suppressed.

Then, in step (2), aluminum metal is melted at a temperature higher than its melting point preferably by from 100 to 150° C., and the molten metal is supplied to the mold and brought into contact with the pre-heated molded product, and the molten metal is pressurized by using a pressurizer in such a state, so that the molded product is pressure impregnated with the molten metal by molten metal forging. The degree of pressurization is at least 10 MPa, preferably from 20 to 100 MPa. In step (2), if the temperature of the molten metal exceeds a temperature higher by 150° C. than the melting point, deliquescent aluminum carbide is likely to form, and no practical composite material will be obtained. Further, if the pressure does not reach 10 MPa, impregnation with the metal component will not efficiently be carried out, and the metal filling rate may decrease.

Now, a specific example of a molten metal forging apparatus (hereinafter referred to as the present apparatus) used for production of the carbon fiber Ti—Al composite material of the present invention will be described with reference to drawings. FIG. 1 is a cross section schematically illustrating the present apparatus. In FIG. 1, numerical reference 1 designates a mold, 2 a punch, and 3 a pressing machine. As shown in FIG. 1, the present apparatus comprises a mold 1 having a space in its inside and a punch 2, and has such a structure that the punch 2 is closely contacted to inner walls of the opening of the mold 1, freely moves toward the inside and outside directions of the opening of the mold 1 and is movable toward the inside direction by the pressing machine 3. A molded product 4 is put in the mold 1 and pre-heated in an argon gas, and then molten metal 5 heated at a predetermined temperature is supplied, the molten metal 5 in the mold is pressurized by the punch 2 and maintained in such a state for a predetermined time. After a lapse of the predetermined time, a solidified product is taken out from the mold 1 together with the block of aluminum metal, and the aluminum metal portion is removed by cutting, dissolution or another method to obtain a carbon fiber Ti—Al composite material.

Figure 2:
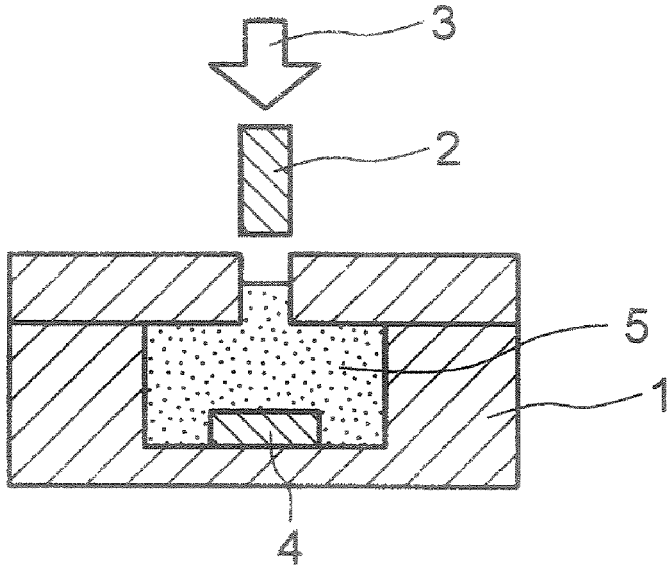
FIG. 2 is a cross section schematically illustrating a closed mold system molten metal forging apparatus.

Further, as the molten metal forging method, in addition to the open-mold system (direct pressurizing system) shown in FIG. 1, a closed-mold system (indirect pressurizing system shown in FIG. 2 may also be applied.

In the carbon fiber Ti—Al composite material of the present invention thus produced the volume fraction of the fine carbon fibers contained is preferably from 20 to 70 vol % more preferably from 30 to 60 vol %. If the volume fraction is smaller than 20 vol % physical properties (strength, heat) tend to be low, and on the other hand, if it is larger than 70 vol %, uniform impregnation tends to be difficult. Further, the volume fraction of the carbon long fibers is preferably from 0.5 to 50 vol %, more preferably from 5 to 50 vol %. If the volume fraction is smaller than 0.5 vol %, no effect of improving strength and elastic modulus will be obtained, and on the contrary, if it is larger than 50 vol %, the Ti—Al component relatively reduces, whereby strength between the fibers may be low. In the present invention, the volume fraction is the percentage of the volume of each material component in the carbon fiber Ti—Al composite material.

Further, in the carbon fiber Ti—Al composite material of the present invention, the volume fraction of the titanium powder or the titanium oxide powder constituting the molded product is preferably from 15 to 50 vol %, more preferably from 20 to 40 vol %. If the molded product is impregnated with aluminum metal, part of titanium is reacted with aluminum metal to form an Al—Ti intermetallic compound. By formation of the Al—Ti intermetallic compound, heat resistance and hardness will be high, and a moderate coefficient of friction and its stability can be obtained. Thus, if the fraction is less than 15 vol % heat resistance tends to be insufficient, and if it exceeds 50 vol %, most of aluminum metal forms an Al—Ti intermetallic compound, whereby the toughness of the obtained composite material will be remarkably low.

Further, when the carbon fiber Ti—Al composite material obtained by molten metal forging is subjected to heat treatment at a temperature of at least 550° C. as disclosed in Patent Document 1, its strength and hardness can be improved. As the heat treatment conditions the temperature is preferably lower by from about 10 to about 100° C. than the melting point of aluminum metal, and the heat treatment time is preferably from 0.5 to 24 hours.

The carbon fiber Ti—Al composite material of the present invention has a high thermal conductivity, high hardness and strength and is thereby suitably used particularly for a slide material for a brake. In this case, since it has a thermal conductivity of at least 50 W/(m·K) and strength of from 100 to 300 MPa, problems of the conventional slide material for a brake will be solved.

The carbon fiber Ti—Al composite material of the present invention is excellent particularly as a slide material for a brake as mentioned above, but its application is not limited thereto, and it can be used as a material in a wide range of fields such as an engine component, a machine tool platen, a turbine blade and a robot arm.

EXAMPLES

Now, the present invention will be described in further detail with reference to Examples and Comparative Examples but the present invention is by no means restricted to such specific Examples. For evaluation of the quality and performance of the carbon fiber Ti—Al composite material prepared in Examples and Comparative Examples, the following measurement methods were employed.

Density: Measured by means of Archimedes' principle by using an electronic analytical balance AEL-200 manufactured by Shimadzu Corporation.

Bending strength: Bending strength was measured with respect to a prepared strength test specimen by using a precision universal testing apparatus AG-500 manufactured by Shimadzu Corporation Measurement was carried out under conditions with a test specimen size of 4 mm×4 mm×8 mm with a span of 60 mm at a cross head speed of 0.5 mm/min.

Thermal conductivity: Determined as a product of the thermal diffusivity, the specific heat and the density. The thermal diffusivity was measured by means of laser flash method by using T-7000 manufactured by ULVAC RIKO INC. at 25° C. Further as the irradiation beam a ruby laser beam (excitation voltage: 2.5 kv, one homogenizing filter and one excitation filter) was used.

Coefficient of thermal expansion: The coefficient of thermal expansion from room temperature to 300° C. was measured by using a thermal analyzer 001, TD-5020 manufactured by Mac Science Co., Ltd.

Elastic modulus: Determined by calculation from stress-strain data in the strength test.

Example 1

A mixture comprising 50 parts by weight of fine carbon fibers comprising vapor grown carbon fibers having a fiber diameter of 150 nm, a fiber length of 15 μm and an aspect ratio of 100 treated in an argon gas atmosphere at a temperature of 2,800° C. for 30 minutes, 20 parts by weight of carbon long fibers (XN-80, manufactured by NIPPON GRAPHITE FIBER CORPORATION, fiber diameter: 10 μm, fiber length: 3 mm), 50 parts by weight of a titanium powder (average particle size: 100 μm) and 16 parts by weight of a phenolic resin (trade name: LA-100P, manufactured by LIGNYTE CO., LTD) was prepared, and using this mixture, a plate-shaped molded product (length: 125 mm, width: 105 mm, thickness: 12 mm) was produced by hot plate pressing under conditions at 160° C. under 20 MPa).

The molded product was pre-heated at 7600° C. in an argon gas and disposed in a mold pre-heated at 500° C. Then, aluminum melted at 810° C. was put in the mold and pressurized by a pressing machine by means of a punch under a pressure of 500 kg/cm$^2$ (about 49 MPa) so that the molded product was pressure impregnated with the above aluminum by molten metal forging, and maintained in such a state for 30 minutes. After cooling, the molded product was taken out together with the block of aluminum, followed by cutting to obtain a carbon fiber Ti—Al composite material.

The carbon fiber Ti—Al composite material had a density of 2.5 g/cm$^3$, a thermal conductivity of 80 W/mK, a coefficient of linear expansion of $10\times10^{-6}$/° C. an elastic modulus of 130 GPa and a bending strength of 250 MPa.

Example 2

Example Wherein Fine Carbon Fibers Covered with a Phenolic Resin and Carbon Long Fibers are Used The same operation as in Example 1 was carried out except that fine carbon fibers covered with a phenolic resin prepared as mentioned below were used as the fine carbon fibers.

(Preparation of Fine Carbon Fibers Covered with a Phenolic Resin)

20 Parts by weight of bisphenol A (solubility in water at room temperature: 0.036), 365 parts by weight of phenol, 547 parts by weight of 37 wt % formalin and 7.7 parts by weight of triethylamine were charged in a reaction container. Then, 1,835 parts by weight of fine carbon fibers graphitized by subjecting vapor grown carbon fibers having a fiber diameter of 150 nm, a fiber length of 15 μm and an aspect ratio of 30 to heat treatment in an argon gas atmosphere at a temperature of 2,800° C. for 30 minutes, and 1,500 parts by weight of water were charged (amount of hydrophobic bisphenol A: 5 wt % of phenols). The temperature was raised to 90° C. over a period of 60 minutes while the mixture was stirred, and reaction was carried out as it was for 4 hours. Then, after cooling to 20° C., the content in the reaction container was collected by filtration using a Buchner funnel to obtain fine carbon fibers covered with a phenolic resin having a water content of 22 wt %. The fibers were dried in a circulating hot air dryer at a temperature in a dryer of 45° C. for about 48 hours to obtain fine carbon fibers covered with a phenolic resin having a phenolic resin content of 15 wt %.

The obtained carbon fiber Ti—Al composite material had a density of 2.5 g/cm$^3$, a thermal conductivity of 100 W/mK, a coefficient of linear expansion of $10\times10^{-6}$/° C., an elastic modulus of 290 GPa and a bending strength of 290 MPa.

INDUSTRIAL APPLICABILITY

The carbon fiber Ti—Al composite material according to the present invention has hardness, heat resistance and abrasion resistance, has reduced weight and improved strength and thermal conductivity, and is excellent in uniformity of the quality. Thus, it is suitable, for example, as a slide material for a brake or a material for an engine component, a robot arm and the like.

The invention claimed is:

1. A carbon fiber Ti—Al composite material comprising:

fine carbon fibers having a fiber diameter of from 0.5 to 500 nm, having a fiber length of at most 1,000 μm, and having a hollow-structured central axis, carbon long fibers having a fiber diameter of from 5 to 15 μm, a titanium powder or a titanium oxide powder, and aluminum or an aluminum alloy, wherein said carbon fiber Ti—Al composite material is prepared by pressure impregnating a molded product with the aluminum or the aluminum alloy by molten metal forging, and wherein said molded product comprises:

the fine carbon fibers, the carbon long fibers, and the titanium powder or the titanium oxide powder.

2. The carbon fiber Ti—Al composite material according to claim 1, wherein the fine carbon fibers are fine carbon fibers graphitized by heat treatment at a temperature of at least 2,300° C. in a non-oxidizing atmosphere.

3. The carbon fiber Ti—Al composite material according to claim 1, wherein the volume fraction of the fine carbon fibers is from 20 to 70%.

4. The carbon fiber Ti—Al composite material according to claim 1, wherein the volume fraction of the carbon long fibers is from 0.5 to 50%.

5. The carbon fiber Ti—Al composite material according to claim 1, wherein the content of the titanium powder or the titanium oxide powder is from 15 to 50 vol %.

6. The carbon fiber Ti—Al composite material according to claim 1, wherein the fine carbon fibers and/or the carbon long fibers are fine carbon fibers covered with a thermosetting resin, the surface of which is covered with a thermosetting resin in an amount of from 1 to 40 parts by weight per 100 parts by weight of the fibers.

7. A process for producing the carbon fiber Ti—Al composite material according to claim 1, said process comprises:

mixing the fine carbon fibers, the carbon long fibers, and the titanium powder or the titanium oxide powder to form the molded product, pre-heating the molded product in an inert atmosphere, disposing the pre-heated molded product in a pressure mold, and pressure impregnating the molded product with a molten metal of aluminum or an aluminum alloy by molten metal forging under a pressure of at least 20 MPa.

8. The process for producing the carbon fiber Ti—Al composite material according to claim 7, wherein a binder is added to the mixture of the fine carbon fibers, the carbon long fibers and the titanium powder or the titanium oxide powder.

9. The process for producing the carbon fiber Ti—Al composite material according to claim 7, wherein the fine carbon fibers and/or the carbon long fibers are fibers, the surface of which is covered with a thermosetting resin.

10. The process for producing the carbon fiber Ti—Al composite material according to claim 9, wherein the fine carbon fibers and/or the carbon long fibers are fibers, the surface of which is covered with the thermosetting resin in an amount of at most 40 parts by weight per 100 parts by weight of the fibers.

* * * * *